US010519910B2

(12) United States Patent
Soerensen et al.

(10) Patent No.: US 10,519,910 B2
(45) Date of Patent: Dec. 31, 2019

(54) VALVE FOR METERING A FLUID, ESPECIALLY A FUEL INJECTOR

(71) Applicant: Robert Bosch GmbH, Stuttgart (DE)

(72) Inventors: Jens Soerensen, Ludwigsburg (DE); Lars Opfer, Ludwigsburg (DE); Peter Keck, Weissach-Flacht (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/155,504

(22) Filed: Oct. 9, 2018

(65) Prior Publication Data

US 2019/0113012 A1 Apr. 18, 2019

(30) Foreign Application Priority Data

Oct. 12, 2017 (DE) ..... 10 2017 218 224

(51) Int. Cl.
*F02M 51/06* (2006.01)
*F02M 61/12* (2006.01)
*F02M 61/18* (2006.01)

(52) U.S. Cl.
CPC ..... *F02M 51/066* (2013.01); *F02M 61/12* (2013.01); *F02M 61/188* (2013.01); *F02M 51/0614* (2013.01)

(58) Field of Classification Search
CPC ..... F02M 51/06; F02M 51/066; F02M 61/12; F02M 61/188; F02M 51/0614
See application file for complete search history.

(56) References Cited

U.S. PATENT DOCUMENTS 8,656,591 B2 * 2/2014 Roessler ..... F02M 51/0664 29/527.2
2003/0127547 A1 * 7/2003 Nowak ..... F02M 61/1853 239/596

FOREIGN PATENT DOCUMENTS

DE 102013219027 A1 3/2014
EP 2333306 A1 6/2011

* cited by examiner

*Primary Examiner* — Hieu T Vo
(74) *Attorney, Agent, or Firm* — Norton Rose Fulbright US LLP; Gerard Messina

(57) ABSTRACT

A valve (or fuel injector), which provides that the valve-seat member exhibits high structural strength and fatigue strength under vibratory stresses, includes an excitable actuator for actuating a valve-closing member which, with a valve-seat face on the valve-seat member, forms a sealing seat, and injection openings which are downstream of the valve-seat face, the injection openings being in a center area of the valve-seat member projecting outwardly dome-like in the injection direction. The dome-like center area has a curved outer contour, the curvature in a radially inner section having a larger radius than the radius of the curvature in a radially outer section of the dome, which ends radially outside the mouth areas of all injection openings, in a recessed depression, that is followed radially outwardly by an axially projecting edge area of the valve-seat member. The fuel injector directly injects fuel into a combustion chamber of an engine.

11 Claims, 3 Drawing Sheets

VALVE FOR METERING A FLUID, ESPECIALLY A FUEL INJECTOR

RELATED APPLICATION INFORMATION

The present application claims priority to and the benefit of German patent application no. 10 2017 218 224.5, which was filed in Germany on Oct. 12, 2017, the disclosure of which is incorporated herein by reference.

FIELD OF THE INVENTION

The present invention is based on a valve for metering a fluid, especially a fuel injector.

BACKGROUND INFORMATION

FIGS. 1, 2*a*, 2*b* and 2*c* show specific embodiments of understood valve-seat members. FIGS. 2*a*, 2*b* and 2*c* show schematic representations of three typical basic constructions of valve-seat members having injection openings. While in the case of the configuration approach according to FIG. 2*c*, the valve-seat member having a flat and even end face closes the downstream valve end of the fuel injector toward the combustion chamber, in the case of the likewise configuration approaches according to FIGS. 2*a* and 2*b*, the valve-seat members are formed with a center area of the valve-seat member that projects outwardly in dome-like manner in the injection direction and includes the injection openings. The dome is either a tapered dome having a conical lateral surface in the center area (e.g., DE 10 2013 219 027 A1) or a rounded dome having a curvature running outwardly in convex, spherical manner (e.g., EP 2 333 306 A1). In both cases, the dome-like center area of the valve-seat member changes over smoothly and steadily into a flat and even end face of the valve-seat member.

In the case of such valve-seat members, the entire dome area is an area critical in terms of strength. It is stressed by the valve needle pounding it millions of times with its valve-closing member. In addition, the system pressure of the fuel acts on the entire inner side of the dome-like center area. These stresses, accompanied by the risk of a deformation of the dome area with negative influence on the quality of the valve-seat face, have an effect on the tightness demands and the endurance strength of the valve-seat member in this area.

SUMMARY OF THE INVENTION

In addition to its simple and cost-effective producibility, the valve of the present invention for metering a fluid having the characterizing features set forth in Claim 1 has numerous other advantages. According to the present invention, a center area—projecting axially in dome-like manner—of the valve-seat member of the valve, especially a fuel injector, is realized in such a way that it has a curved outer contour, the curvature in a radially inner section having a larger radius than the radius of the curvature in a radially outer section of the dome, which ends radially outside of the mouth areas of all injection openings, in a recessed depression, that is followed radially outwardly by an again axially projecting edge area of the valve-seat member, so that in cross-section, a dome contour of the valve-seat member is formed that overall is wave-shaped, but appears flattened in the center area.

Compared to dome-like center areas of valve-seat members according to the related art, the stresses relevant in terms of strength are effectively reduced. Due to the structural separation between the region of the load dissipation ("fundament" of the edge area) and the region for the injection openings ("functional area"), a markedly higher stressability of the dome center is obtained for the dome-like center area.

Thanks to the high stressability, it is possible to reduce the wall thickness of the dome-like center area radially inside, without at the same time increasing the risk of a vibration fatigue failure. Thus, it is conceivable to realize a small wall thickness of only 200 to 300 μm in the center area. On the other hand, in the region of the injection openings, the dome wall strength may be increased by thickenings, the stability of the valve-seat member thereby being increased overall, and the lengthening of the injection openings advantageously permitting a deep penetration of the fluid to be injected, especially fuel, into a combustion chamber.

In addition, it should be stressed that an uncontrolled discharge of fuel immediately after the end of the injection is prevented. Usually upon closing of the fuel injector, the valve needle bounces with the valve-closing member on the valve-seat face, so that undesirable opening phases still follow the closing operation for a brief time. This quantity of fuel delivered in uncontrolled manner leads to a small deviation of the injected quantity of fuel from the setpoint value, so that a disadvantageous effect in the engine operation cannot be ruled out. With the configuration of the dome-like center area according to the present invention, the likelihood of bouncing may be reduced dramatically, since the wave dome exhibits high inherent stability.

A further advantage of the present invention is that less sooty carbon deposit develops on the outer side of the dome-like center area during engine operation than in the case of understood fuel injectors. Due to the configuration of the valve-seat member according to the present invention, a temperature distribution which prevents the rapid buildup of soot deposits is achieved in the component.

Because of the small deposit formation on the surface of the valve-seat member, the configuration of the present invention offers greater protection against blockage of the injection openings ("coking"). In view of the highly fluctuating quality of fuel worldwide, this robust behavior is a great advantage.

A further advantage is that the increase in particulate emissions in the exhaust gas caused by the continuous operation of the engine turns out to be less than in the case of fuel injectors according to the related art (reduction of the PN drift).

The measures delineated in the dependent claims permit advantageous further developments of and improvements to the fuel injector set forth in Claim 1.

It is especially advantageous that the geometric configuration of the valve-seat member at its lower end face facing the combustion chamber may be adapted very flexibly to desired installation conditions and demands on the engine operation.

Exemplary embodiments of the present invention are represented in simplified manner in the drawing and explained in greater detail in the following description.

DETAILED DESCRIPTION

Figure 1:
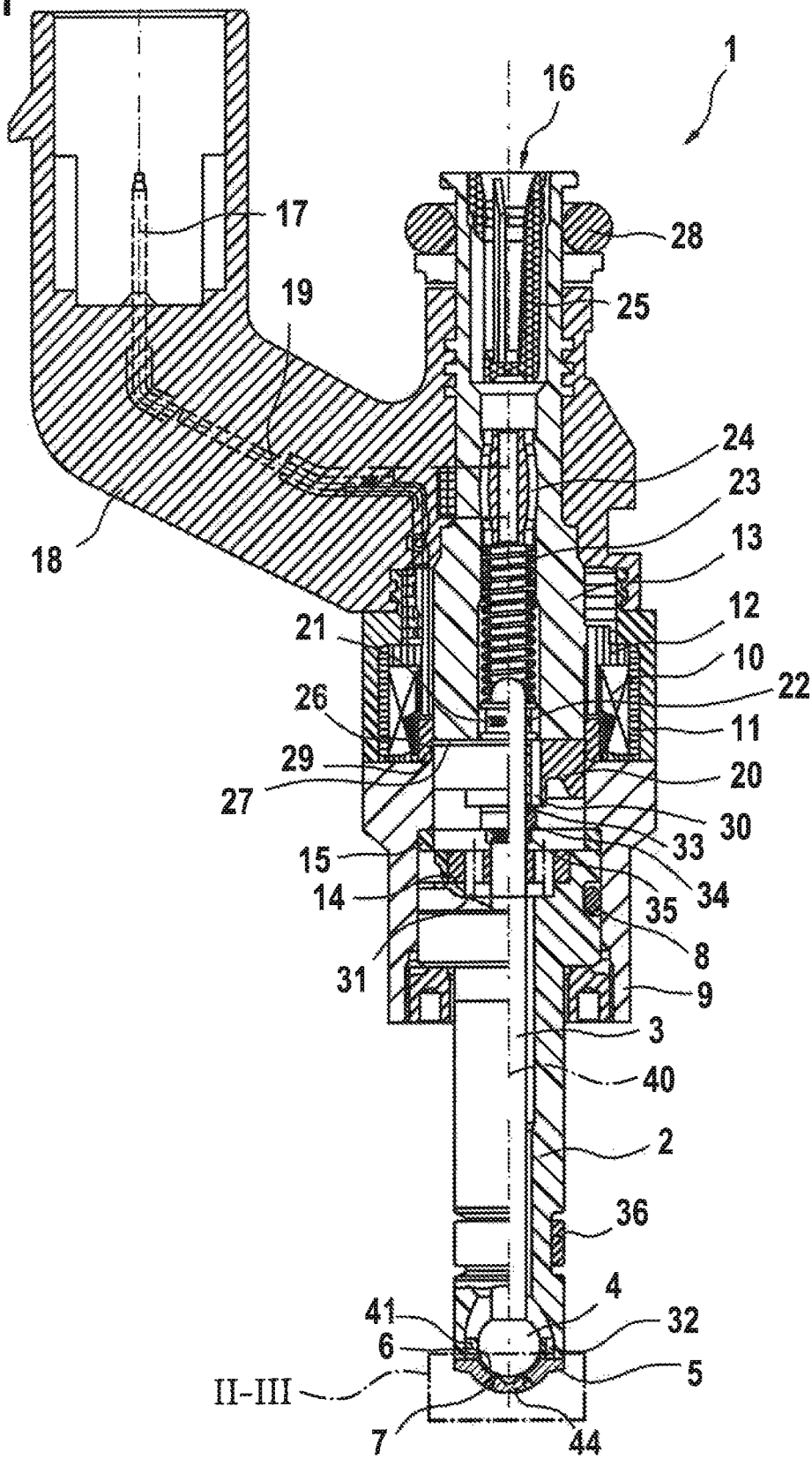
FIG. 1 shows a schematic cross-section through a fuel injector in an understood form having a valve-seat member with injection openings at the downstream end of the valve.

An understood example of a fuel injector 1 shown in FIG. 1 is in the form of a fuel injector 1 for fuel injection systems of mixture-compressing, spark-ignition internal combustion engines. Fuel injector 1 is particularly suited for the direct injection of fuel into a combustion chamber (not shown) of an internal combustion engine. In general, the invention is usable for valves for the metering of a fluid.

Fuel injector 1 is made up of a nozzle body 2, in which a valve needle 3 is disposed. Valve needle 3 is in operative connection with a valve-closing member 4 that interacts with a valve-seat face 6, located on a valve-seat member 5, to form a sealing seat. Valve-seat member 5 and nozzle body 2 may also be realized in one piece. Fuel injector 1 in the exemplary embodiment is an inward opening fuel injector 1 which has at least one injection opening 7, but typically has at least two injection openings 7. Ideally, however, fuel injector 1 takes the form of a multipole injection valve and therefore has between four and thirty injection openings 7. Nozzle body 2 is sealed off from a valve housing 9 by a seal 8. An electromagnetic circuit is used as drive, for example, which includes a solenoid coil 10 as actuator that is encapsulated in a coil case 11 and is wound on a coil carrier 12 that abuts on an inner pole 13 of solenoid coil 10. Inner pole 13 and valve housing 9 are separated from each other by a narrowing 26 and connected to each other by a non-ferromagnetic connecting component 29. Solenoid coil 10 is energized via a line 19 by an electric current able to be supplied via an electrical plug contact 17. Plug contact 17 is surrounded by a plastic sheathing 18, which may be injection-molded on inner pole 13. Alternatively, piezoelectric or magnetostrictive actuators may also be used.

Valve needle 3 is guided in a disk-shaped valve-needle guide 14. A paired adjusting disk 15 is used to adjust the stroke. Located on the other side of adjusting disk 15 is an armature 20. It is joined with force locking via a first flange 21 to valve needle 3, which is joined to first flange 21 by a welded seam 22. A return spring 23 is supported on first flange 21 and in the present construction of fuel injector 1, is preloaded by an adjusting sleeve 24.

Fuel channels 30, 31 and 32 run in valve-needle guide 14, in armature 20 and on a guide member 41. The fuel is supplied via a central fuel feed 16 and filtered by a filter element 25. Fuel injector 1 is sealed off from a fuel rail (not shown) by a seal 28, and from a cylinder head (not shown) by a further seal 36.

On the downstream side of armature 20, an annular damping element 33 is disposed, which is made of an elastomer material. It rests upon a second flange 34, which is joined with force locking to valve needle 3 via a welded seam 35.

When fuel injector 1 is at rest, return spring 23 acts upon armature 20 counter to its stroke direction in such a way that valve-closing member 4 is retained in sealing contact on valve-seat face 6. When solenoid coil 10 is energized, it generates a magnetic field that moves armature 20 against the spring force of return spring 23 in the stroke direction, the stroke being predetermined by a working gap 27 between inner pole 13 and armature 20 in the position of rest. Armature 20 takes along first flange 21, which is welded to valve needle 3, in the stroke direction, as well. Valve-closing member 4, which is joined to valve needle 3, lifts off from valve-seat face 6, and the fuel is injected through injection openings 7.

When the coil current is switched off, after sufficient reduction of the magnetic field, armature 20 falls off of inner pole 13 due to the pressure of return spring 23, whereby first flange 21 joined to valve needle 3 moves counter to the stroke direction. Valve needle 3 is thereby moved in the same direction, so that valve-closing member 4 comes down on valve-seat face 6, and fuel injector 1 is closed.

FIGS. 1, 2*a*, 2*b* and 2*c* show specific embodiments of understood valve-seat members 5. In all further Figures, as well, a comparable section II-III from FIG. 1, each in an enlarged representation, is selected to clarify the form and contouring on valve-seat member 5 according to the present invention.

Figure 2A:
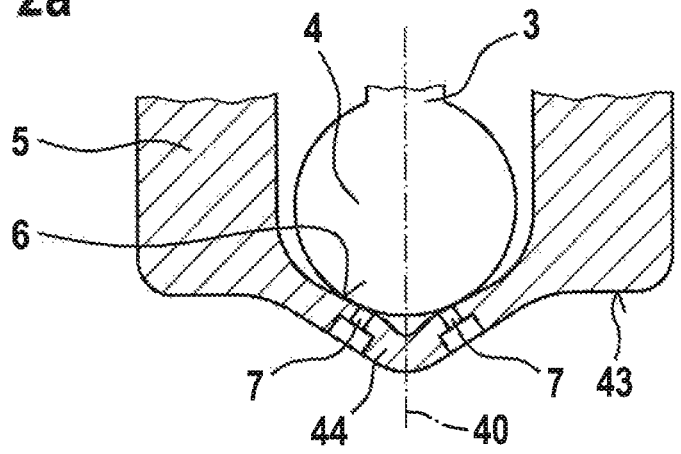
FIGS. 2*a*, 2*b*, and 2*c* show schematic representations of various understood configurations of valve-seat members having injection openings, like section II-III from FIG. 1, each in an enlarged depiction.
Figure 2B:
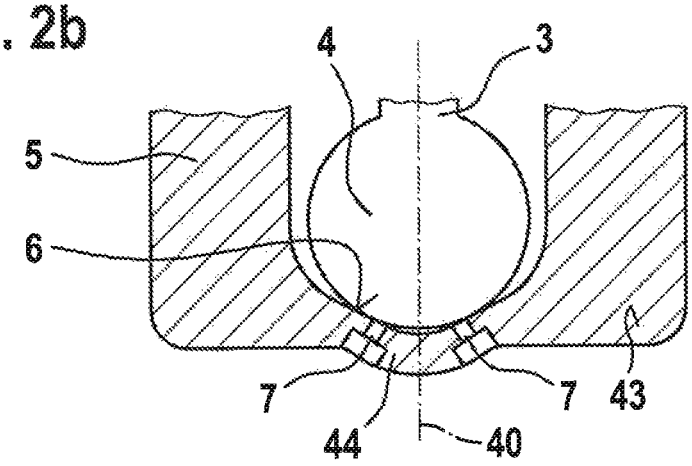
Figure 2C:
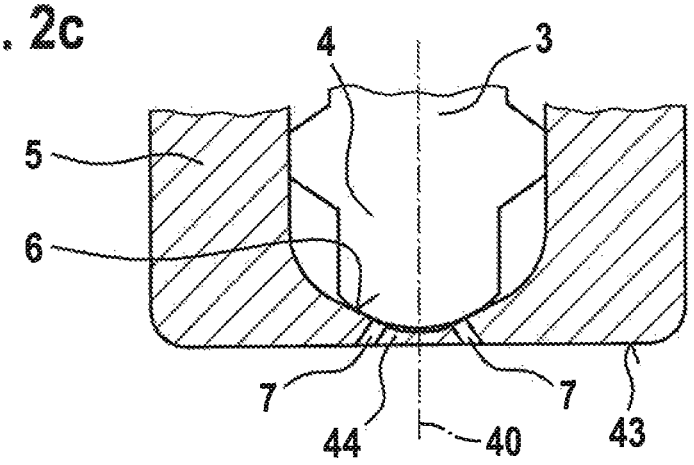

FIGS. 2*a*, 2*b* and 2*c* show very schematic representations of three typical basic constructions of valve-seat members 5 having injection openings 7. While in the case of the understood and proven configuration approach according to FIG. 2*c*, valve-seat member 5 having a flat and even end face 43 closes the downstream valve end of fuel injector 1 toward the combustion chamber, in the case of the likewise understood configuration approaches according to FIGS. 2*a* and 2*b*, valve-seat members 5 are formed with a center area 44 of valve-seat member 5 that is axially symmetrical relative to a longitudinal valve axis 40, projects outwardly in dome-like manner in the injection direction and includes injection openings 7. In the exemplary embodiment according to FIG. 2*a*, the dome is a tapered dome having a conical lateral surface in center area 44, while center area 44 of the specific embodiment according to FIG. 2*b* is in the form of a rounded dome curved outwardly in spherical convex manner. In both cases, dome-like center area 44 of valve-seat member 5 changes over smoothly and steadily into flat and even end face 43 of valve-seat member 5, similar to the construction according to FIG. 2*c*.

The object of the present invention is to produce a valve-seat member 5 for a fuel injector 1 having a plurality of injection openings 7, which in spite of a dome-like center area 44, exhibits particularly high structural strength, thus, is dimensioned to be less sensitive to bending stress than in the related art.

Measurements have shown that small wall thicknesses in center area 44 of valve-seat member 5 and short injection openings 7 have a positive influence on the particulate emissions of the internal combustion engine. However, in the case of these fuel injectors 1 optimized for the lowest possible particulate emissions, there is the danger of a marked increase in component stresses in valve-seat member 5. Therefore, the geometric measures according to the invention for improving the strength provide for increasing the material volume or material thickness locally at places of valve-seat member 5 that are critical in terms of strength.

According to the present invention, dome-like center area 44 of valve-seat member 5 has a curved outer contour, the curvature in a radially inner section having a larger radius than the radius of the curvature in a radially outer section of the dome. In addition, center area 44 of valve-seat member 5 projecting axially in dome-like manner therefore ends radially outside of the mouth areas of all injection openings 7, in a recessed depression 47, which ideally is formed circumferentially and which is followed radially outwardly by at least one again axially projecting edge area 48 of valve-seat member 5, so that in cross-section, an overall wave-shaped dome contour of valve-seat member 5 is formed. As a result, because of the radius variability, center area 44 projecting axially in dome-like manner appears as a flattened dome having a radially bounded expanse and an axial extension projecting, if indeed, only slightly, beyond end face 43.

Figure 3:
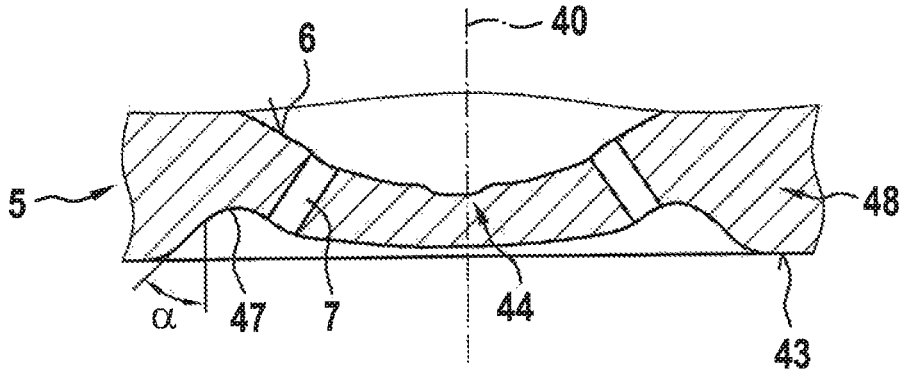
FIG. 3 shows an exemplary embodiment of a valve-seat member according to the present invention in a sectional representation comparable to FIG. 2.

In FIG. 3, an exemplary embodiment of a valve-seat member 5 according to the present invention is shown in a sectional representation comparable to FIG. 2. Dome-like center area 44 is formed ideally to be axially symmetrical relative to longitudinal valve axis 40 and ends radially outside of the mouth areas of all injection openings 7, in a circumferential recessed depression 47, which is notched similarly to an annular bead. Notched depression 47 is followed radially outwardly by an again axially projecting edge area 48 of valve-seat member 5, so that in cross-section, an overall wave-shaped dome contour of valve-seat member 5 is formed. In the present exemplary embodiment, depression 47 and the transition from the radially outer depression edge to edge area 48 in each case are rounded with a quite small radius. Edge area 48 here has a flat and even end face 43.

In order that the added volume of material does not lead directly to a lengthening of injection openings 7, the dome contour of center area 44 in the mouth area of injection openings 7 is provided with its own small radius, so that stresses in the component between injection openings 7 are reduced. Moreover, this special contour brings about an improved injection-spray disintegration of the fluid sprays to be delivered owing to the 3-D ellipses resulting in the discharge region of injection openings 7, and an optimized penetration into the combustion chamber. The 3-D ellipses ensure a longer spray guidance in the circumferential direction or tangentially relative to the valve seat, and a shorter length of injection openings 7 in the radial direction, which benefits the injection-spray disintegration. This applies especially to injection openings 7 running cylindrically without first steps introduced toward the injection side.

In the following, some specific dimension data for describing the contour of center area 44 of valve-seat member 5 are given by way of example in order to illustrate the dimensions without the invention being limited to them. Given a diameter of approximately 6 mm of valve-seat member 5 and therefore of the valve tip of fuel injector 1, the radius of the curvature of center area 44 about longitudinal valve axis 40 amounts to 3 mm to 7 mm, for example. The radius of the curvature of center area 44 decreases radially outwardly to, e.g., 1 mm to 5 mm. In the region of the mouths of injection openings 7 on the dome, the radius may be reduced by a certain material thickening and therefore additional regional bulge, to approximately 0.2 mm to 0.6 mm. Depression 47 may be very small, namely with a radius which should not be greater than 0.5 mm.

In this configuration, the wall thickness of center area 44 of valve-seat member 5 varies from approximately 0.2 to 0.3 mm in the region of longitudinal valve axis 40, to approximately 0.35 to 0.7 mm in the thickened region close to injection openings 7. The wall thickness in the radially outer section of center area 44 may thus be greater by approximately 20 to 250% than the wall thickness in the radially inner section of center area 44. In variants with greater wall thicknesses, the delta between thinnest and thickest wall thickness will turn out to be less, since otherwise the dome becomes too flat.

From depression 47, which serves as relief groove, the contour runs out radially outwardly at an angle $\alpha$ of 0° to a maximum of 70° relative to perpendicular longitudinal valve axis 40, to end face 43 of valve-seat member 5. Depending on the configuration, the angle may also be replaced with a radius greater than 0.5 mm.

In the exemplary embodiment shown in FIG. 3, at its axially furthest projecting section on longitudinal valve axis 40, center area 44 advantageously also has an offset back relative to end face 43. Alternatively, however, center area 44 may also end with its projecting axial extension at the level of end face 43, or may project axially slightly beyond end face 43. In all cases, however, depression 47 is offset back axially relative to end face 43 of valve-seat member 5. This type of back-offset valve seat offers decisive strength advantages for valve-seat member 5.

The combination of a greater wall thickness at injection openings 7 and depression 47 minimizes the maximum stresses occurring locally at the spray-orifice outlet, since the added material is better able to dissipate the forces introduced. In the case of great spray-orifice inclinations, the stresses are radial to injection opening 7 in interaction with depression 47. Therefore, it is necessary to dimension the radius of depression 47 to be as small as possible, in order to achieve improved strength between depression 47 and injection opening 7. In the case of small inclinations, the highest stresses are between injection openings 7. In that case, the thickened region at radially outer center area 44 reduces the stresses developing there. An optimum of strength is achieved by the geometric configuration of depression 47 and thickenings in the region of injection openings 7.

In addition, depression 47 is used for the circulation of air, which benefits the disintegration of the injection fluid spray. It also helps to protect injection openings 7 from deposits of combustion products and combustion-chamber gases. The flat dome of center area 44 in combination with the combustion-chamber flow, influenced by depression 47, help to evaporate fuel deposited on the dome.

The slight outwardly projecting thickenings in the region of injection openings 7 may be provided in such a way that injection openings 7 lead exactly into them. The result is that the length of injection openings 7 increases, which in turn leads to sprays that are guided longer, and advantageously improves the penetration. In such a configuration, injection openings 7 run at an angle of approximately 45° relative to the longitudinal valve axis. However, it is also conceivable for injection openings 7 to run more steeply relative to the longitudinal valve axis, thus, at an angle of less than 45°, so that injection openings 7 then open out at the dome radially inward of the thickening.

Injection openings 7 in valve-seat member 5 may be formed both with a larger-diameter first step running toward the injection side, as shown in all embodiments, but may also run cylindrically, conically with positive or negative opening angle, or in multi-step manner or the like. In cross-section, all forms are conceivable for injection openings 7, from round to oval to polygonal. In this context, injection openings 7 are produced by eroding, laser drilling or punching. Injection openings 7 may either be made with a sharp edge at the spray-orifice inlet and/or outlet, or alternatively, may be rounded by hydroerosive eroding, for example.

Steel may be used as a typical material for valve-seat member 5. Therefore, dome-like center area 44 may be produced by machining (e.g., turning, grinding, honing), by forming (e.g., extrusion) or by primary forming (e.g., metal injection molding). However, besides steel, other metallic materials or ceramic materials are possible for valve-seat member 5, as well.

The present invention is not limited to the exemplary embodiment shown and, for example, is usable for differently disposed injection openings 7 as well as for any constructions of inward-opening multipole fuel injectors 1.

What is claimed is:

1. A fuel injector, which is a valve for metering a fluid, for directly injecting fuel into a combustion chamber, for a fuel injection system of an internal combustion engines, comprising:

an excitable actuator to actuate a valve-closing member which, together with a valve-seat face formed on a valve-seat member, forms a sealing seat, and including at least one injection opening which is formed downstream of the valve-seat face, the at least one injection opening being placed in a center area of the valve-seat member projecting outwardly in a dome-like manner in the injection direction;

wherein the dome-like center area of the valve-seat member has a curved outer contour, the curvature in a radially inner section having a larger radius than the radius of the curvature in a radially outer section of the dome, which ends radially outside of the mouth areas of all injection openings, in a recessed depression, that is followed radially outwardly by an again axially projecting edge area of the valve-seat member.

2. The fuel injector of claim 1, wherein in cross-section, an overall wave-shaped dome contour of the valve-seat member is formed, the center area appearing as a flattened dome because of the variability in radius.

3. The fuel injector of claim 1, wherein the dome-like center area is formed to be axially symmetrical relative to a longitudinal valve axis, and the depression runs circumferentially accordingly.

4. The fuel injector of claim 3, wherein the circumferential recessed depression is notched like an annular bead.

5. The fuel injector of claim 1, wherein the depression and/or the transition from the radially outer depression edge to the edge area is sharp-edged or rounded.

6. The fuel injector of claim 1, wherein the edge area has a flat and even end face.

7. The fuel injector of claim 1, wherein the wall thickness of the center area of the valve-seat member varies in the radial direction, the wall thickness being less in the radially inner section than in the radially outer section of the dome.

8. The fuel injector of claim 7, wherein the wall thickness in the radially outer section of the center area is greater by approximately 20 to 250% than the wall thickness in the radially inner section of the center area.

9. The fuel injector of claim 1, wherein material thickenings are provided in the region of the injection openings.

10. The fuel injector of claim 1, wherein the center area, surrounded radially by the depression, is either offset back or placed forward in terms of its axial extension relative to the radially outwardly extending edge area of the valve-seat member, or both areas lie with their end faces in roughly one and the same plane, the bottom of the depression always being offset back relative to the end face.

11. The fuel injector of claim 1, wherein between two and thirty injection openings are provided in the valve-seat member.

* * * * *